US005544028A

United States Patent [19]

Carlin

[11] Patent Number: 5,544,028

[45] Date of Patent: Aug. 6, 1996

[54] LIGHT SYSTEM WITH LIGHT HOLDER

[75] Inventor: T. Christopher Carlin, Council Grove, Kans.

[73] Assignee: A/C Enterprises, Inc., Council Grove, Kans.

[21] Appl. No.: 543,489

[22] Filed: Oct. 16, 1995

[51] Int. Cl.[6] ..... F21V 21/00

[52] U.S. Cl. ..... 362/249; 362/226; 362/396; 362/806

[58] Field of Search ..... 362/249, 396, 362/806, 226, 382

[56] References Cited

U.S. PATENT DOCUMENTS

| | | | |
|---|---|---|---|
| 3,836,760 | 9/1974 | Robinson | 240/10 R |
| 4,107,767 | 8/1978 | Anquetin | 362/236 |
| 4,173,035 | 10/1979 | Hoyt | 362/806 |
| 4,482,944 | 11/1984 | Roossine et al. | 362/806 |
| 4,510,555 | 4/1985 | Mori | 362/32 |
| 4,514,791 | 4/1985 | Tokieda | 362/249 |
| 4,950,958 | 8/1990 | Lin | 315/185 R |
| 4,999,755 | 3/1991 | Lin | 362/250 |
| 5,018,055 | 5/1991 | Wu | 362/249 |
| 5,031,083 | 7/1991 | Claesson | 362/249 |
| 5,067,061 | 11/1991 | Prickett | 362/145 |
| 5,095,413 | 3/1992 | Goldberg | 362/238 |
| 5,404,279 | 4/1995 | Wood | 362/806 |

FOREIGN PATENT DOCUMENTS

| | | | |
|---|---|---|---|
| 586694 | 12/1958 | Italy | 362/249 |

*Primary Examiner*—Denise L. Gromada
*Assistant Examiner*—Alfred Basichas
*Attorney, Agent, or Firm*—Litman, McMahon and Brown, L.L.C.

[57] ABSTRACT

A lighting system includes a string of light units connected by electrical wiring and a holder assembly for receiving the light units at spaced intervals. The holder assembly includes a base and a pair of sidewalls extending therefrom, which collectively form a channel or passage extending longitudinally and receiving the electrical wiring. The holder assembly has a closed configuration with the sidewalls converging at a relatively closed mouth and an open configuration with a light unit received between the sidewalls. The holder assembly comprises a resilient, flexible material which accommodates closed configurations of the holder assembly between respective light unit locations. The light system can be mounted on a supporting structure by a suitable fastener attached to the holder assembly base.

22 Claims, 4 Drawing Sheets

LIGHT SYSTEM WITH LIGHT HOLDER

BACKGROUND OF THE INVENTION

1. Field of the Invention

The present invention relates generally to lighting, and in particular to a system for mounting string lighting.

2. Description of the Related Art

Various lighting systems are available for meeting the requirements of particular applications. For example, string lighting comprising strings of individual light units is commonly available and generally consists of multiple sockets electrically interconnected by wiring in either a series or a parallel configuration. Such string lighting is commonly used for ornamental purposes where aesthetics are important. String lighting can also be used to provide illumination and to visually outline such areas as walkways, stair wells, etc. Such usages of string lighting are sometimes temporary, e.g. for holiday decoration, whereafter the light strings can be removed and stored for future use. Such light strings tend to be relatively inexpensive per light unit, and are often constructed of lightweight materials.

A common problem with light strings relates to difficulties in mounting them in relatively uniformly spaced, straight lines. Previous mounting methods for string lighting tended to be relatively imprecise and/or time consuming to practice. For example, previous methods of mounting string lighting have included providing mechanical fasteners for securing the wiring which interconnects the individual light units at spaced locations along a structure on which the light string is being mounted. However, installing light strings with mechanical fasteners tends to be relatively time consuming and inaccurate whereby achieving straight runs of uniformly spaced light units can require careful, individual placement of the mechanical mounting fasteners. Moreover, the wiring interconnecting the individual light units typically remains exposed in such installations, which can detract from the appearance of the installation and expose the wiring to possible damage due to its unprotected condition.

The present invention addresses some of the shortcomings of previous string lighting installation methods. Heretofore there has not been available a light holder with the advantages and features of the present invention.

SUMMARY OF THE INVENTION

In the practice of the present invention, a light system is provided which includes a string of light units each comprising a socket receiving a bulb, the individual sockets being interconnected by electrical wiring to form a lighting string. The lighting system includes a holder assembly with a base and a pair of sidewalls extending therefrom to form a longitudinally-extending channel or passage. The holder assembly has a closed configuration with its sidewalls converging towards a mouth formed by upper edges of the sidewalls, and an open configuration receiving the socket of a light unit. The electrical wiring can extend through the holder assembly channel between respective light units. The holder assembly can be mounted on a supporting structure by suitable mechanical fasteners, a hook-and-loop fastening system or by adhesive.

OBJECTS AND ADVANTAGES OF THE INVENTION

The principle objects and advantages of the present invention include providing a light system; providing such a light system which is adapted for mounting string lighting; providing such a light system which provides relatively straight, uniform and evenly-spaced mounting of string lighting; providing such a light system which protects the wiring interconnecting the individual light units of string lighting from exposure to the elements; providing such a lighting system which provides a uniform aesthetic appearance for string lighting and providing such a lighting system which is economical to manufacture, efficient in operation and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
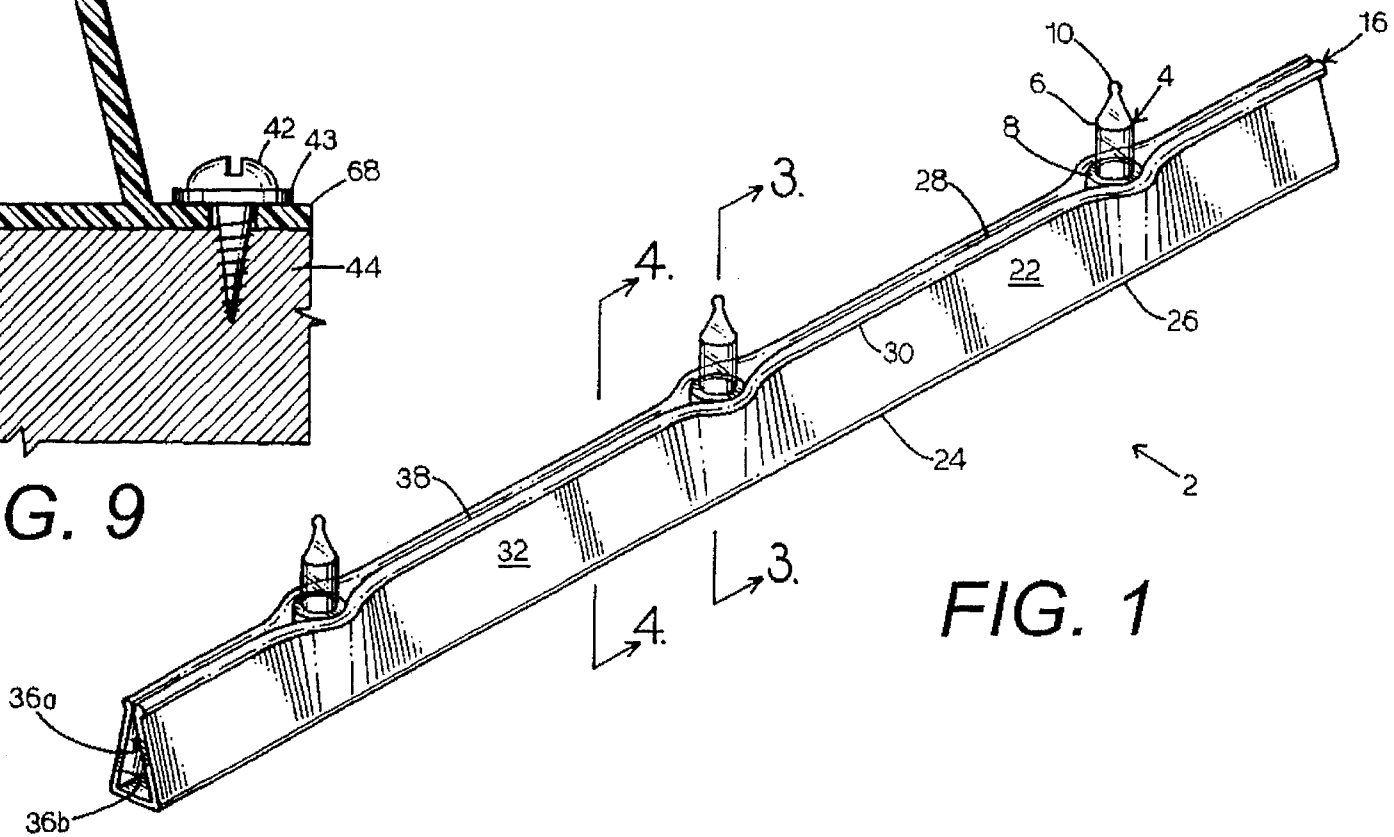
FIG. 1 is an upper perspective view of a string lighting system embodying the present invention, shown with a light string mounted in a holder assembly.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a light system including string illumination means comprising a string 4 of electrical light units 6 each comprising a socket 8 receiving a bulb 10. The sockets 8 are interconnected by electrical wiring 12, and are preferably wired in parallel relationship with each other. The electrical wiring 12 is also adapted for connection to a suitable electrical power source by such means as a plug-and-socket, an electrical junction box, etc. The bulbs 10 can comprise any suitable size, style and color and can be incandescent or some other suitable type.

The light system 2 generally comprises the string illumination means 4 consisting of the components described above and mounting means comprising a holder assembly 16 therefor.

II. Holder Assembly 16

The holder assembly 16 has a generally elongated configuration and can comprise any suitable material, such as polypropylene, which can be selected for its flexibility and memory characteristics, as well as the ability to be extruded. The holder assembly 16 includes a relatively flat base 18 with opposite side edges 20 extending in spaced, parallel relation longitudinally. The holder assembly 16 also includes a pair of sidewalls 22 each having a lower edge 24 whereat said sidewall 22 is integrally connected to said base 18 along a respective side edge 20 thereof, thereby forming a linear base-to-sidewall connection 26.

Each sidewall 22 includes an upper edge 28 whereat a longitudinally-extending ridge 30 projects laterally outwardly from an exterior face 32. The sidewalls 22 further include interior faces 34 which, together with the base 18, form a longitudinally-extending channel or passage 36 with a generally triangular cross section.

Figure 3:
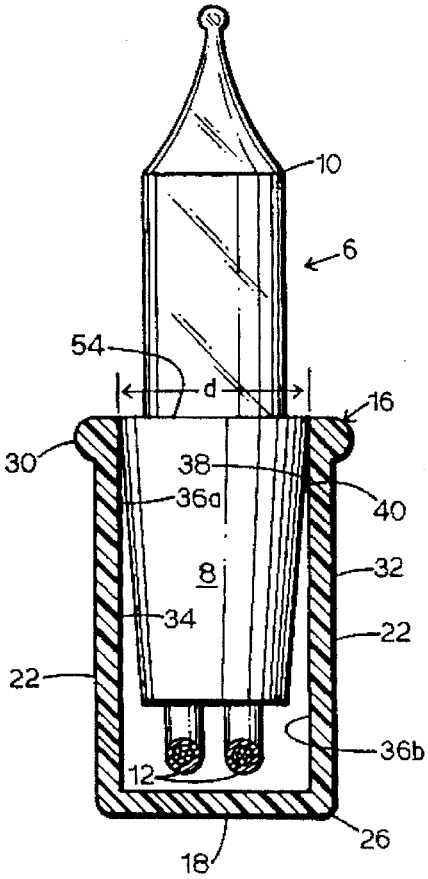
FIG. 3 is a transverse, cross-sectional view thereof taken generally along line 3—3 in FIG. 1 and particularly showing the mounting of a light unit in the holder assembly showing the holder assembly in an open configuration thereof.
Figure 4:
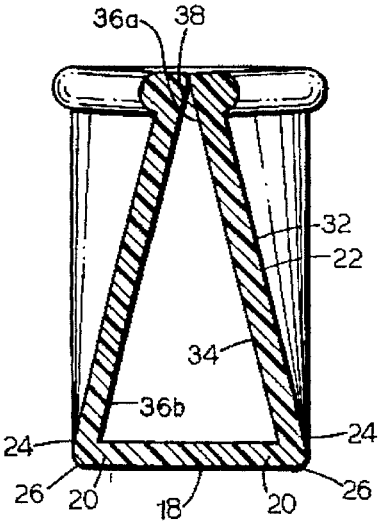
FIG. 4 is a transverse, cross-sectional view thereof taken generally along line 4—4 in FIG. 1 and particularly showing the holder assembly in a closed configuration thereof.

The holder assembly 16 has closed and open crosssectional configurations as shown in FIGS. 4 and 3 respectively. With the holder assembly 16 in its closed configuration, the sidewalls 22 converge in a direction from the base 18 to their upper edges 28 whereat a holder assembly mouth 38 has a relatively closed configuration (FIG. 4). At the location of each light unit 6, the channel 36 has a relatively open configuration with the mouth 38 in an open configuration whereby the sidewall upper edges 28 are spaced apart and the sidewalls 22 are in parallel, spaced relation for engaging a light unit socket 8 (FIG. 3). The sidewalls 22, and particularly the upper edge 28, converge along lengths of the holder assembly 16 away from the center lines of the light units 6 whereby the light unit sockets 8 are engaged by the sidewalls 22 over significant areas of contact 40. The light units 6 are thus resiliently retained in place by a spring action of the holder assembly 16. With the light units 6 in place, the channel or passage is divided into an upper chamber **36*a* receiving the light unit sockets 8 and a lower chamber 36*b* receiving the electrical wiring 12**.

III. Installation and Operation

Figure 5:
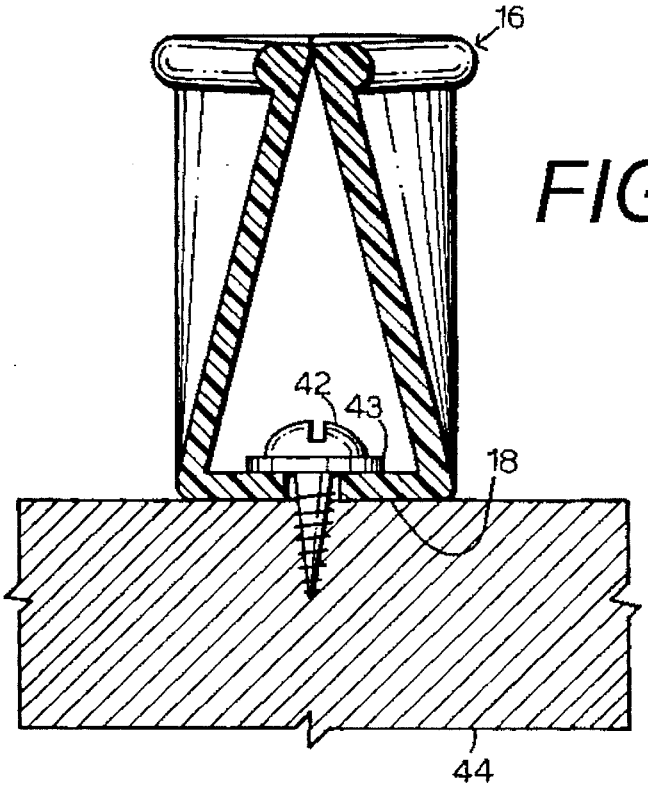
FIG. 5 is a transverse, cross-sectional view of the light system shown with the holder assembly mounted with a mechanical fastener.

The lighting system 2 can be installed in a wide variety of applications using various mounting techniques. For example and without limitation on the generality of useful mounting procedures, FIG. 5 shows the holder assembly 16 mounted with mechanical fasteners comprising screws 42 extending through the base 18 and through washers 43 from inside the channel 36 and into a supporting structure 44. Other types of mechanical fasteners, such as nails, staples, rivets, etc., could also be employed.

Figure 6:
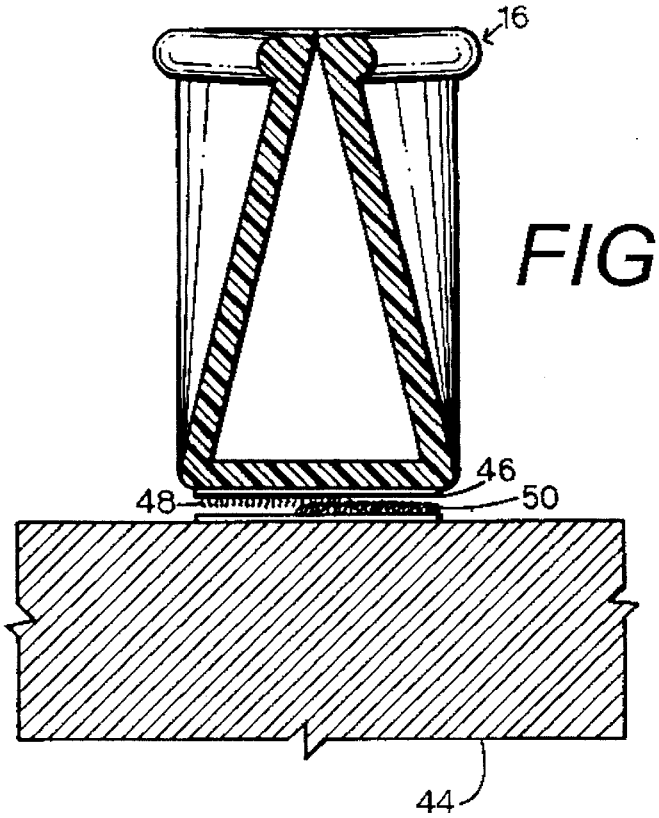
FIG. 6 is a transverse, cross-sectional view of the light system, shown with the holder assembly mounted on the supporting structure by a hook-and-loop fastener.

FIG. 6 shows a hook-and-loop fastening system 46 including a strip of hook material 48 mounted on the supporting structure 44 and a strip of loop material 50 mounted on the base 18 for selective, releasable mounting engagement therebetween.

Figure 7:
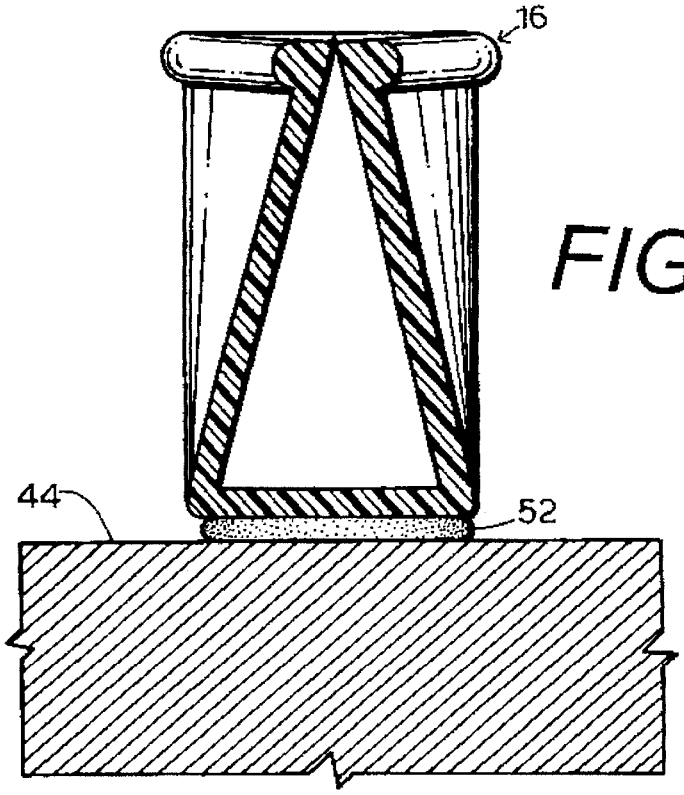
FIG. 7 is a transverse, cross-sectional view of the light system, shown with the holder assembly mounted on the supporting structure by a layer of adhesive.

FIG. 7 shows an adhesive fastening system comprising a layer of adhesive 52 applied to the structure 44 and the base 18 therebetween for adhesively bonding the light system 2 in place. It will be appreciated that various types of adhesive can be utilized to meet the requirements of particular applications.

Figure 8:
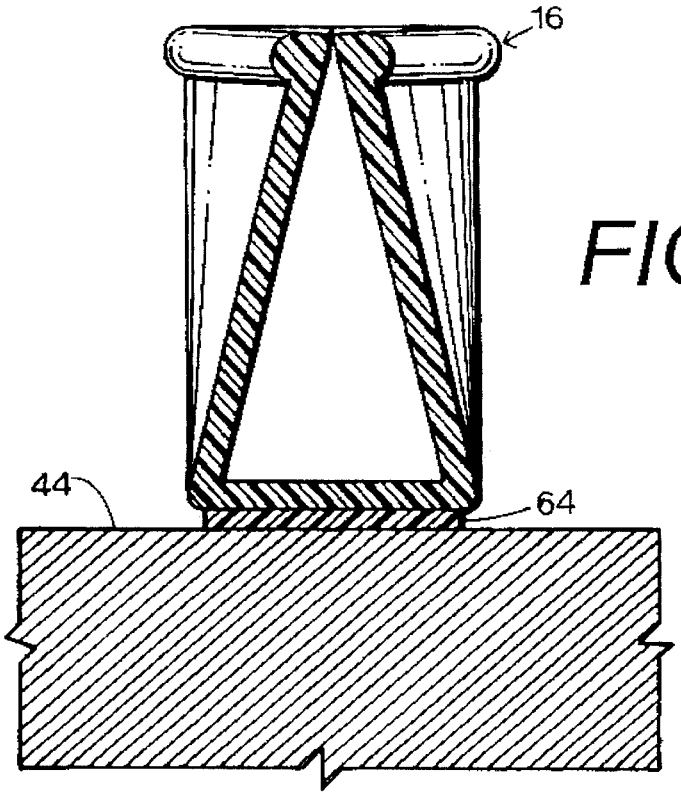
FIG. 8 is a transverse, cross-sectional view of the light system, shown with the holder assembly thereof mounted on the supporting structure by two-sided tape.

FIG. 8 shows a further alternative fastening system for the holder assembly 16 comprising a strip of two-sided tape 64 adhesively engaging the supporting structure 44 and the holder assembly base 18.

The light unit string 4 can be installed in the holder assembly 16 by spreading the sidewall upper edges 28 and generally aligning the socket rims 54 with the sidewall upper edges 28. The resilient character of the holder assembly 16 facilitates placement of the individual light units 6 at various locations along the holder assembly 16.

IV. Alternative Embodiment Light System 55

Figure 9:
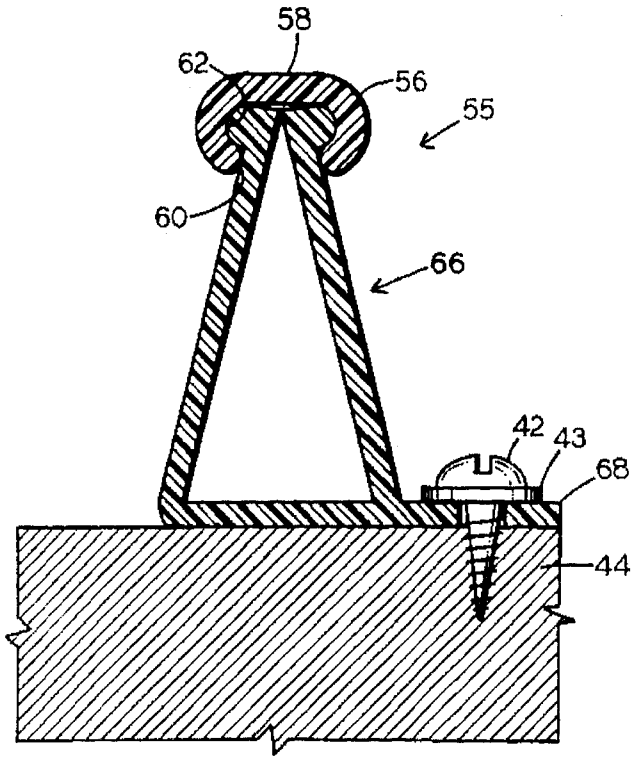
FIG. 9 is a transverse, cross-sectional view of a light system comprising a first modified or alternative embodiment of the present invention with an optional cap and an optional side flange for mounting the holder assembly.
Figure 2:
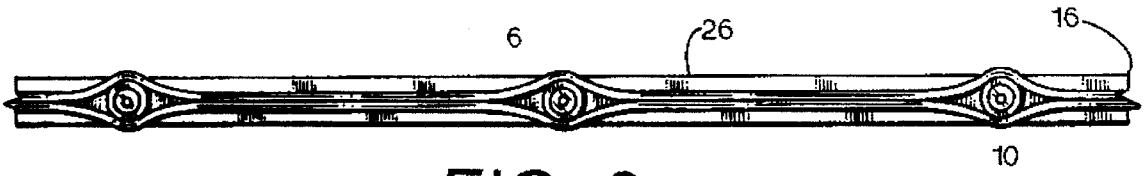
FIG. 2 is a top plan view thereof.

FIG. 9 shows a light system 55 comprising a first modified or alternative embodiment of the present invention with an optional holder assembly cap 56 comprising a top plate 58 and a pair of flanges 60 depending downwardly from the top plate edges and forming inwardly open grooves 62 for receiving the sidewall upper edge ridges 30 in releasable engagement therewith. The optional caps 56 can be used for achieving and maintaining a predetermined spacing of the light units 6. Thus, multiple caps 56 could be placed on a length of the lighting system 2 with the light units 6 spaced at regular, periodic intervals therebetween.

The alternative embodiment light system 55 further includes a modified holder assembly 66 with a mounting flange 68 extending laterally from a sidewall lower edge 24 in generally coplanar relationship with a holder assembly base 18. The mounting flange 68 is adapted for receiving mechanical fasteners (e.g., screws 42, etc.) extending therethrough and into the supporting structure 44. The mounting flange 68 can be extruded continuously with the holder assembly 66, or, alternatively, spaced, individual mounting flanges 68 could be provided at spaced intervals along the length of the holder assembly 16. Mounting flanges 68 could be provided on one or both sides of the holder assembly 66.

It is to be understood that while certain forms of the present invention have been illustrated and described herein, it is not to be limited to the specific forms or arrangement of parts described and shown.

What is claimed and desired to be secured by Letters Patent is as follows:

1. A light holder for a light unit including a socket and a bulb mounted in said socket, which includes:

(a) a base with,opposite side edges;

(b) a pair of sidewalls each having a lower edge connected to a respective base side edge and an upper edge; and (c) a closed cross-sectional configuration with said sidewall upper edges in close proximity to each other and an open configuration with a light socket located between said sidewalls with said sidewall upper edges being positioned in spaced relation.

2. The invention of claim 1 wherein said holder comprises a plastic material including memory means.

3. The invention of claim 1 wherein said material comprises polypropylene.

4. The invention of claim 1 wherein each said sidewall upper edge includes an outwardly-protruding, radiused ridge.

5. The invention of claim 4 which includes:

(a) a cap having a top plate with opposite side edges, a pair of retainers depending downwardly from said top plate side edges, and a pair of grooves formed by said retainers and open inwardly, each said groove receiving a respective ridge.

6. The invention of claim 1 which includes a channel formed by said base and sidewalls.

7. The invention of claim 6 wherein said channel includes an upper compartment adapted to receive a light socket and a lower compartment adapted to receive wiring.

8. The invention of claim 1, which includes:

(a) mounting means associated with said base for mounting said holder.

9. The invention of claim 8 wherein said mounting means comprises mechanical fasteners extending through said base.

10. The invention of claim 8 wherein said mounting means comprises adhesive means mounted on an exterior surface of said base.

11. The invention of claim 8 wherein said mounting means comprises two-sided tape attached to an exterior surface of said base.

12. The invention of claim 8 wherein said mounting means comprises a hook-and-loop type fastener.

13. The invention of claim 8 wherein said mounting means comprises a flange extending laterally from a respective sidewall lower edge in generally coplanar relationship with said base and a mechanical fastener extending through said flange.

14. The invention of claim 1 which includes an open section with said sidewalls in their respective open configurations and receiving a light socket and a pair of closed sections each located adjacent said open section with said open section therebetween, said sidewalls being in their closed configurations at said closed sections and said sidewall upper edges curving around said socket at said open section and converging at said closed sections.

15. A strip lighting system, which includes:

(a) a light string including multiple sockets, multiple bulbs each received in a respective socket, and electrical wiring electrically interconnecting said sockets and having means for connection to a power source;

(b) a holder including:

(1) a base with opposite side edges;

(2) a pair of opposite sidewalls each having a lower edge attached to a respective base side edge and an upper edge;

(3) a pair of ridges each located at a respective sidewall upper edge and protruding outwardly from said sidewall, each said ridge having a radiused edge;

(4) a closed configuration with said sidewall upper edges in close proximity to each other;

(5) an open configuration with said sidewall upper edges in spaced apart relation;

(6) an open section with said sidewall upper edges in their respective open positions and a respective socket received therebetween;

(7) a plurality of closed sections each located adjacent to a respective open section and having said sidewalls in their closed configurations thereat;

(8) said sidewall upper edges curving around respective sockets at said open sections and converging at said closed sections; and (9) said sidewalls and said base forming a channel with an upper compartment receiving said sockets and a lower compartment receiving said wiring; and (c) mounting means associated with said base for mounting said holder.

16. The invention of claim 15 wherein said holder comprises polypropylene plastic.

17. The invention of claim 15, which includes:

(a) a cap having a top plate with opposite side edges, a pair of retainers each depending downwardly from a respective top plate side edge, and a pair of grooves formed by said retainers and open inwardly, each said groove receiving a respective ridge.

18. The invention of claim 15 wherein said mounting means comprises mechanical fasteners extending through said base.

19. The invention of claim 15 wherein said mounting means comprises adhesive means mounted on an exterior surface of said base.

20. The invention of claim 15 wherein said mounting means comprises two-sided tape attached to an exterior surface of said base.

21. The invention of claim 15 wherein said mounting means comprises a hook-and-loop type fastener.

22. The invention of claim 15, which includes:

(a) a base flange extending laterally outwardly from a respective sidewall lower edge in substantially coplanar relationship with said base; and (b) said mounting means comprising a mechanical fastener extending through said base flange.

* * * * *